United States Patent [19]

Greppi

[11] Patent Number: 4,972,789

[45] Date of Patent: Nov. 27, 1990

[54] MAST FOR SAILBOATS

[76] Inventor: Luigi Greppi, Largo Richini, 6, 20122 Milano, Italy

[21] Appl. No.: 315,904

[22] Filed: Feb. 27, 1989

[30] Foreign Application Priority Data

Feb. 29, 1988 [IT] Italy ..... 19581 A/88

[51] Int. Cl.[5] ..... B63B 15/00

[52] U.S. Cl. ..... 114/90; 114/102

[58] Field of Search ..... 114/39.1, 90, 102, 104, 114/105–108, 112

[56] References Cited

U.S. PATENT DOCUMENTS

| | | | |
|---|---|---|---|
| 3,851,609 | 12/1974 | Stearn | 114/105 |
| 3,882,810 | 5/1975 | Roeser | 114/112 |
| 4,367,688 | 1/1983 | Godfrey | 114/107 |
| 4,593,638 | 6/1986 | Cochran et al. | 114/90 |
| 4,704,979 | 11/1987 | Ammen et al. | 114/98 |
| 4,712,500 | 12/1987 | Montandon | 114/90 |

FOREIGN PATENT DOCUMENTS

| | | | |
|---|---|---|---|
| 0076878 | 4/1983 | European Pat. Off. . | |
| 1921682 | 11/1970 | Fed. Rep. of Germany . | |
| 3516156 | 7/1986 | Fed. Rep. of Germany | 114/102 |
| 7330280 | 3/1974 | France . | |
| 2561204 | 9/1981 | France . | |
| 2496046 | 6/1982 | France . | |
| 2539379 | 7/1984 | France . | |
| 2555957 | 6/1985 | France . | |
| 1022696 | 3/1966 | United Kingdom . | |

*Primary Examiner*—Peters, Jr. Joseph F.
*Assistant Examiner*—Jesûs D. Sotelo
*Attorney, Agent, or Firm*—Sixbey, Friedman, Leedom & Ferguson

[57] ABSTRACT

The invention concerns a mast for sailboats, apt to support two distinct sailcloths forming a wing sail. According to the invention, the mast comprises a tubular body which has a cross section divided in two parts by an axis transversal to the longitudinal axis of the boat, a first part facing the bow and a second part facing the stern. The first part facing the bow has a markedly convex or substantially semielliptic curved profile, while the second part facing the stern has a rounded tip profile or a substantially semicircular profile. Said tubular body comprises anchor means for the two sailcloths forming the wing sail, positioned along two generatrices crossing two points which are symmetrical in respect of the center or coinciding with the center of said first part facing the bow. Also according to the invention, the cross section of said tubular body comprises at least one cavity, opening outwards into a slot extending along one of said generatrices, said slot being crossed by one of the sailcloths and said cavity housing said anchor means for said sailcloth.

29 Claims, 6 Drawing Sheets

XXI
XXI
13
12
56
55
54
53
50
V
V
55
12
56
56
13
13
12
56
55
52
50
51
57
58
V

MAST FOR SAILBOATS

BACKGROUND OF THE INVENTION

It is now widely diffused, in sailing races, to make use of highly sophisticated crafts and sailing equipment—as masts of light metal alloys, light and strong sailcloths, thin ropes for the standing and running rigging, composite structures for the masts and hulls—so as to obtain valid competitive results in regattas.

The present invention concerns a mast for sailboats with improved characteristics.

As known, the possibility for a sailboat to sail up to windward greatly depends—in boats with conventional equipment, and other conditions being equal—not only on the lightness of the mast, but also and above all on the fact of constructing it with a small cross section area, so as to prevent wakes and whirlwinds (diagrammatically indicated by T in FIG. 1 of the accompanying drawings).

It is however possible to eliminate the whirlwinds created by the mast, thereby increasing its efficiency, by making the structure of the sail more complex, for instance in the form of a wing incorporating the mast A (as diagrammatically indicated in FIG. 2 of the accompanying drawings). This solution allows in fact to emphasize the camber of the extrados in respect of the intrados camber, so as to increase—according to the Bernoulli theorem—the air speed Ve in respect of Vi, and thereby improve the lift S2 and the useful wind thrust F3.

An attempt in this sense has already been made in the past, but this solution involved such complications as to make its application rare and difficult. In practice, this solution has been adopted only on some regatta catamarans: "Miss Lancia" was using for example a mast with two sailcloths (FIG. 3) having inner elastic wingribs and apt to be worked by means of ropes so as to form a wing contour, which thus became symmetrical on the two sides.

A solution of this type is for example described in the FR-A-2.555.957, wherein the mast is on one hand mounted rotating about its axis and, on the other hand, it has a contour apt to be radiused to the two sailcloths, so as to form therewith essentially a wing contour with a symmetrical leading edge (see, in particular, FIGS. 3 and 4 of the FR-A-2.555.957).

On the other hand, it is also a known and now diffused custom, on yachts as well as on regatta boats, to furl the sail VE inside the mast A (FIGS. 5 and 6), rolling it up around a vertical rotary mandrel P positioned along the axis of the mast, so as to avoid the manual work of shortening the sail in the traditional way with reefs, as the wind increases its force. For this purpose the mandrel P, inserted into a cavity C of the mast A, is rotated by hand (with a handle and suitable transmission) or by means of electric and/or hydraulic motors. FIG. 7 of the drawings is a very clear enlargement of a typical shape of the cross section of one of these masts A (as described, for example, in the EP-A2-0076878).

A still different construction was adopted on "Icarus", wherein the rotary mast AR had a cross section extending and tapered towards the stern (FIG. 4), with a single sailcloth t behind the mast, but wherein the tapered surface of the rotary mast reduced the whirlwinds and allowed, in cooperation with the sailcloth, to approach the wing shape. A solution of this type is proposed, for example, in the DE-A-1.921.628.

SUMMARY OF THE INVENTION

A first object of the invention is to realize a mast for sailboats, apt to support two distinct sailcloths and forming therewith an optimal wing contour—of the type of that described in the FR-A-2.555.957—but with improved technical characteristics and a higher lift and efficiency.

A further object of the invention is to realize a mast for sailboats combining the advantages of the already cited FR-A-2.555.957 and EP-A2-0076878 in a structure of great efficiency and of particularly convenient use.

These main objects—as well as further objects better specified hereinafter—are reached in a mast structure for sailboats comprising a tubular body provided with anchor means for two distinct sailcloths forming a wing sail according to the present invention, which is essentially characterized in that said tubular body has a cross section divided in two parts by an axis transversal to the longitudinal axis of the boat, a first part facing the bow and a second part facing the stern, the first part facing the bow having a markedly convex or substantially semielliptic curved profile, while the second part facing the stern has a rounded tip profile or a substantially semicircular profile, and in that said anchor means for the two sailcloths forming the wing sail are positioned along two generatrices crossing two points which are symmetrical in respect of the centre or coinciding with the centre of said first part facing the bow.

According to a preferred embodiment, the tubular body of the mast has a cross section substantially like an isosceles triangle, whose base forms said first part facing the bow and whose sides converge into a rounded apex forming said second part facing the stern. The sides of the isosceles triangle form an angle of less than 45° in respect of said transversal axis of the mast.

According to a different embodiment, the mast has a substantially asymmetric elliptic cross section, having its major axis coinciding with said transversal axis, the part of said ellipse facing the stern having a bending radius which is smaller than the bending radius of the part facing the bow.

A mast for sailboats, having a section formed of a rounded bow part and of a stern part shaped as an isosceles triangle, has actually been already described in the DE-A-1.921.682. This mast, though resembling at first sight the mast of the embodiment of the invention shown in FIG. 8, differs however fundamentally therefrom for the following features:

the bow part is shaped as a circle arc wider than 180°;

the stern part is shaped as an isosceles triangle with a very acute angle and with a scarcely rounded apex;

the generatrices of anchorage of the sailcloths (which besides, in the case of the DE-A-1.921.682, are not two distinct sailcloths, but two simple union cloths) are positioned on the stern part. It will be quite evident from the following description that these differences are sufficient not to allow reaching the results of the invention.

In fact, a first fundamental advantage of the invention derives from the fact that—as better explained hereinafter—the mast has a cross section such as to allow the twin sail to automatically form a proper wing contour—with the wind blowing both on one side and, symmetrically, on the other side, and especially when close-hauling—with no whirlwind areas, while the mast remains fixed about its axis. In the DE-A-1.921.682, in spite of the attempt to obtain a contour allowing to prevent whirlwinds, this result cannot be reached due to the presence of a union cloth which is loose on the leeward side. The FR-A-2.555.957 allows instead to obtain a correct wing contour, even when sailing close-hauled, but it is in any case necessary to rotate the mast about its axis.

Another, equally important advantage of the invention, which had never been obtained up to date, lies in the fact that the cross section of the mast, though being symmetrical in respect of the longitudinal axis of the boat, is however configured so that the leading edge of said wing contour—as also better explained hereinafter—is asymmetrical in respect of the direction of the wind, and such as to realize optimal conditions of lift and of efficiency.

BRIEF DESCRIPTION OF THE DRAWINGS

A plurality of constructive details and further interesting characteristics of the invention will anyhow appear more evident from the following detailed description, given with reference to the accompanying drawings, which show some embodiments thereof by way of non-limiting example, and in which.

DESCRIPTION OF THE PREFERRED EMBODIMENTS

Figure 8:
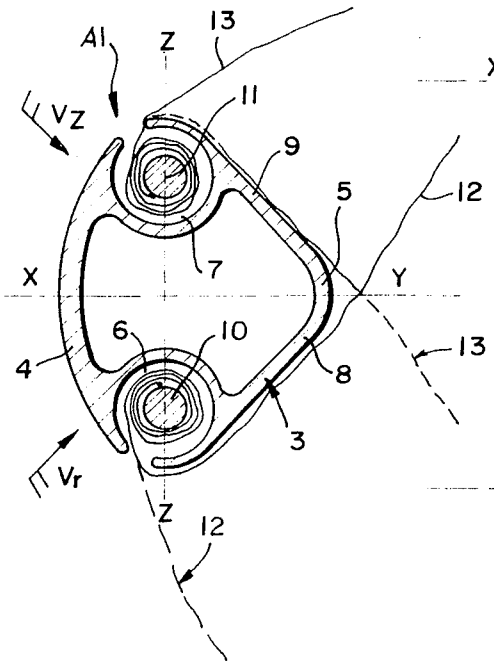
FIG. 8 is a cross section view of a preferred embodiment of the mast according to the invention.

As shown in FIG. 8, the mast AI according to the invention is formed as a tubular body consisting of a light alloy section 3, shaped—as shown in the drawing—like an isosceles triangle having a markedly convex curved base 4 and a rounded apex 5 opposite to the base. In correspondence of the other two apices of the triangle there are formed, in the mast cross section, two substantially circular cavities 6 and 7, smoothly radiused to the base 4 and to the two sides 8 and 9 of the triangle converging into the apex 5. These cavities have slots extending throughout the length of the mast and opening in correspondence of two generatrices crossing two points of the curved base 4, which are symmetrical in respect of the longitudinal axis x-y and close to the two base apices of the triangle.

A mast with this cross section thus appears as having a markedly convex curved surface and two substantially flat surfaces radiused by a rounded apex opposite to said curved surface, which latter finds itself—with the mast mounted on the rigged craft—facing the bow.

Figure 17:
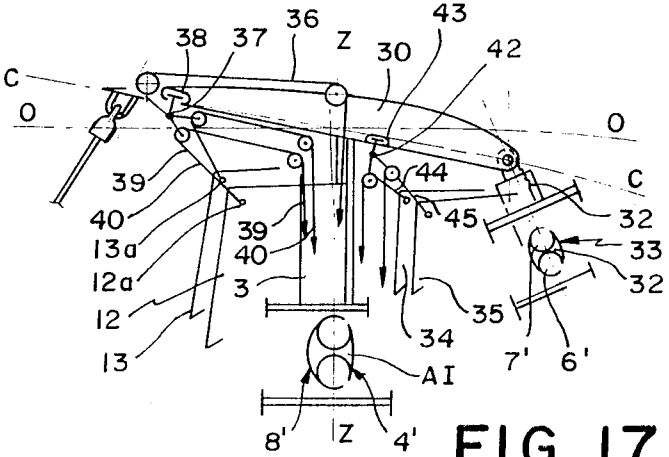
FIG. 17 is a lateral part section view of the masthead with the winglet.
Figures 19, 20, 21, 22:
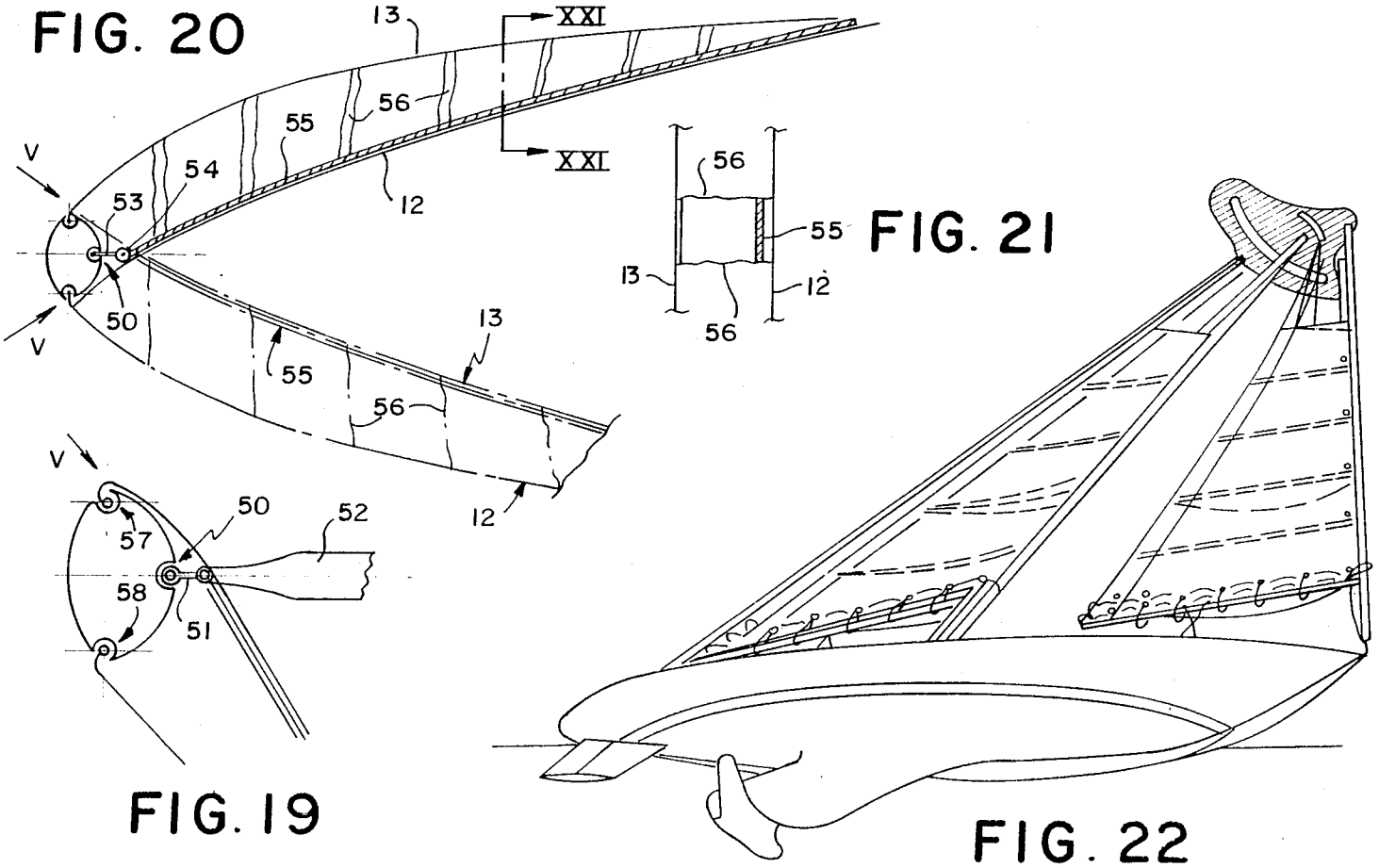
FIG. 19 is a diagrammatic section view of a further embodiment of the mast according to the invention.
FIG. 20 is a diagrammatic plan view showing the use of the mast of FIG. 19.
FIG. 21 shows a detail of the system to guide the battens stiffening the wing sail, along the line XXI—XXI of FIG. 20.
FIG. 22 is a view similar to that of FIG. 16, showing a mast according to the embodiment of FIG. 19.

Preferably, the flat surfaces or sides 8 and 9 of the mast form an angle not wider than 45° in respect of the transversal axis z-z of the mast, for the function better described hereinafter. Moreover, said flat surfaces may also be slightly bent or may even form, together with the rounded apex 5, a single curved surface, as shown in the embodiments of FIGS. 17 and 19, described hereinafter.

The mast AI may have a uniform cross section, or it may be tapered towards the top.

Inside the cavities 6 and 7 of the mast AI there are mounted rotary support mandrels 10 and 11, for rolling up the sailcloths 12 and 13. The mandrels 10, 11, are rotated by manual control or, preferably, by means of hydraulic and/or electric motors.

The mast AI may be formed, as well as of light alloy (preferably by extrusion), also of synthetic fibres, resins and hardening compounds.

Figure 1:
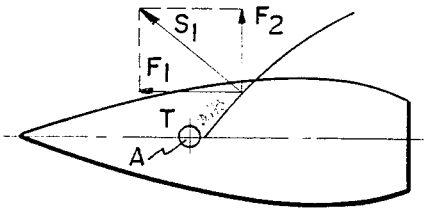
FIG. 1 PRIOR ART
FIG. 1 is a sketched plan view of a conventional sailboat, showing the whirlwinds in correspondence of the mast and the directions of the wind thrusts.
Figure 2:
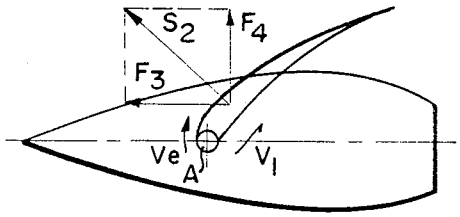
FIG. 2 PRIOR ART
FIG. 2 is a sketch similar to that of FIG. 1, showing a boat equipped with a sail forming in theory a wing.
Figure 3:
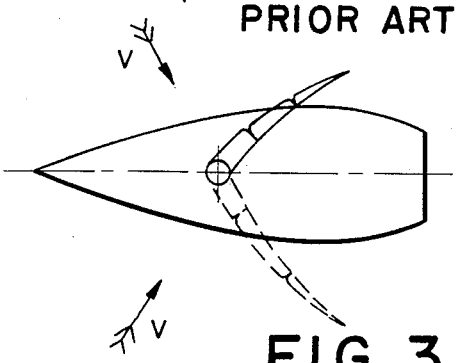
FIG. 3 PRIOR ART
FIGS. 3 and 4 illustrate, always in the form of sketches, two solutions of known technique to eliminate the whirlwinds created by the mast.
Figure 4:
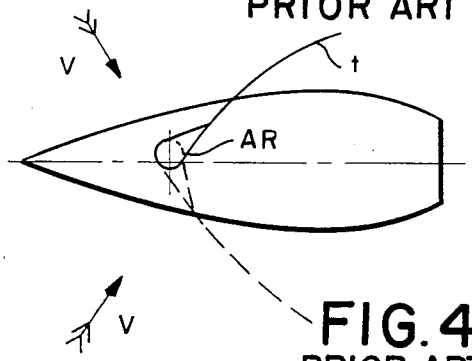
FIG. 4 PRIOR ART
Figure 5:
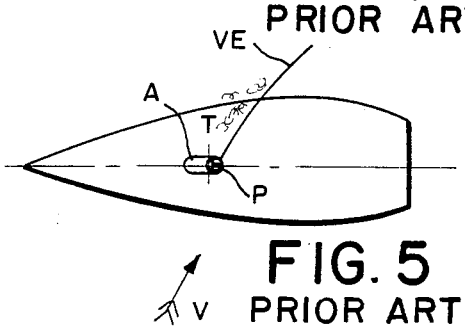
FIG. 5 PRIOR ART
FIGS. 5 and 6 are two views of a conventional boat, equipped with a mast comprising means for rolling up and housing the sail.
Figure 6:
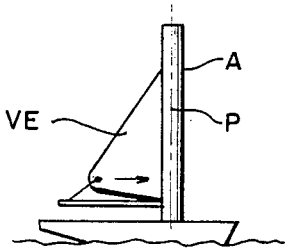
FIG. 6 PRIOR ART
Figure 7:
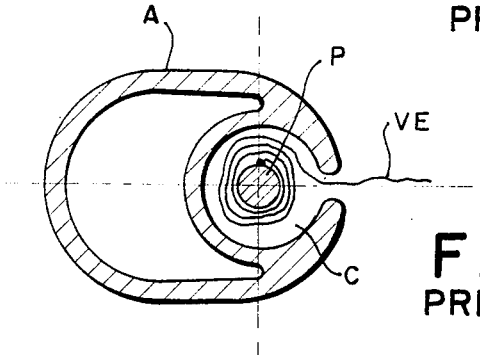
FIG. 7 PRIOR ART
FIG. 7, is a cross section view of the mast of FIGS. 5 and 6, provided with a cavity for housing the sail and with a rotary support in said cavity.
Figure 9:
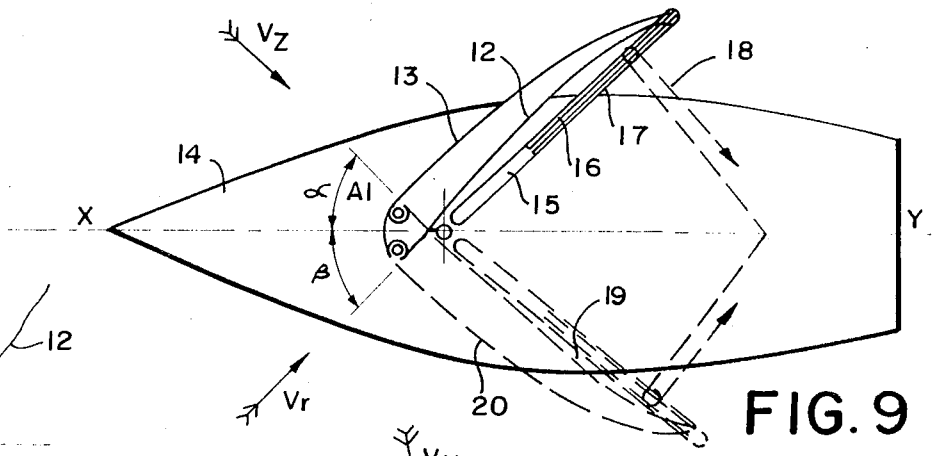
FIGS. 9 to 12 show sailboats equipped with the mast of FIG. 8, according to the invention, and the different uses of said mast for the purposes of the invention.

As shown in FIG. 9, the mast AI according to the invention is mounted on a sailboat 14 in a symmetrical position in respect of the longitudinal axis X-Y of the boat, and the sailcloths 12 and 13, which are driven out of its cavities 6 and 7 by being unrolled from the mandrels 10 and 11, are anchored in a conventional manner on two rails 16 and 17 provided for the purpose on the boom 15. When hit by the wind, the assembly of the sailcloths 12 and 13 and of the mast AI forms at once—if suitably trimmed—a wing structure, which is apt to solve in the most appropriate way the problem being faced: the sailcloth 12 is guided, out of the cavity 6, along the surface of the mast AI corresponding to the side 8 of its triangular section, while the sailcloth 13 forms an extension, out of the cavity 7, of the curved surface of the mast AI corresponding to the base 4 of said triangular section.

In fact, the contour of the fixed mast AI, substantially radiused to the two sailcloths 12 and 13, allows to prevent whirlwinds and facilitates flowing of the wind, particularly when close-hauling symmetrically on the two sides. With the two sailcloths 12 and 13, the mast AI forms part of a wing contour, apt to take up a symmetrical trim when close-hauling on both sides, by control of the boom 15 through the sheet 18 (as shown in dashed lines, in FIG. 9, with the sailcloths 12 and 13 in the positions 19 and 20). In other words, as the boat always sails in the direction XY, when the apparent wind blows from Vz or, symmetrically, from Vr on the other side, the wing contour can be trimmed always with very narrow angles $\alpha$ and, symmetrically $\beta$. It is known that the point of sailing in which the efficiency of the sails is more determining is in fact when close-hauling. In this condition, the efficiency of the sail with wing contour—formed of the mast with the two sailcloths according to the invention—is considerably increased compared to that of conventional sails with the traditional mast and only one sailcloth, which are instead apt to create very undesirable wakes and resistances.

As already seen (FR-A-2.555.957), masts have been proposed which rotate about their vertical axis in order to keep a correct wing contour when close-hauling symmetrically on both sides. Whereas, the mast according to the invention has a cross section allowing to keep two perfectly correct symmetrical wing contours, though the mast remains fixed about its axis, as clearly illustrated in FIG. 9.

When sailing on the beam or on a free reach, the wing contour might no longer be so correct, but in this case the efficiency of the contour becomes no doubt less important. Nevertheless, also the mast according to the invention can—especially on competition boats—be mounted rotating about its own axis.

Figure 10:
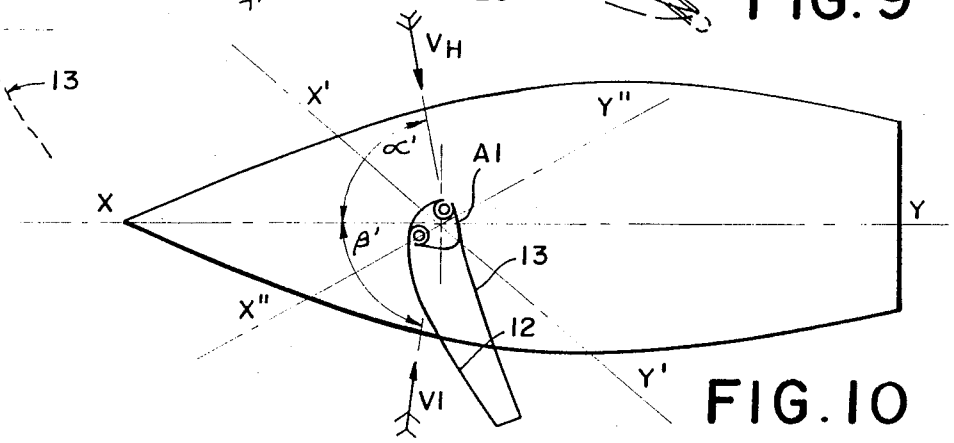

Also in the case of the mast AI according to the present invention—as shown in FIG. 10—a rotation about its vertical axis can, in certain cases, improve the shape of the wing sail formed of said mast AI and of the two sailcloths 12 and 13. This happens in particular when sailing on the beam or on a free reach, i.e. when the wind blows from Vh (or symmetrically from Vi): namely when, instead of blowing from the direction Vz (or symmetrically from Vr) with angles $\alpha$ and $\beta$, the wind blows from Vh (or symmetrically from Vi) with angles $\alpha' > \alpha$ and $\beta' > \beta$. In this case, the median plane x-y of the mast—which, in the case of a fixed mast (FIG. 9), always coincides with the plane X-Y of the boat—can be rotated up to the position x' y' and symmetrically x'' y''. This solution presents no problems as far as mounting the mast on the boat which, as said, has already been done (FR-A-2.555.957).

On the other hand, the mast according to the invention provides another very important advantage, which was never obtained by known technique. It lies in the fact that—as already mentioned—the cross section of the mast, though being symmetrical in respect of the longitudinal axis of the boat, allows however to form a leading edge of the wing contour which turns out to be asymmetrical: as it appears evident from FIG. 9, the extrados of the leading edge has in fact a considerable camber, while the intrados is almost flat. When sailing close-hauled, especially full and by, this configuration of the leading edge thus allows to obtain optimal lift conditions. Also the efficiency is thereby improved, so that it becomes possible to sail up to windward, pinching the wind with a very narrow angle—for instance even narrower than 30°–35°—between the wind direction and the boat axis, which would be practically impossible with the boats of known technique.

In some cases, for instance with a light breeze, it may be advantageous to use only one of the two sailcloths 12 and 13 housed in the mast AI.

Figure 11:
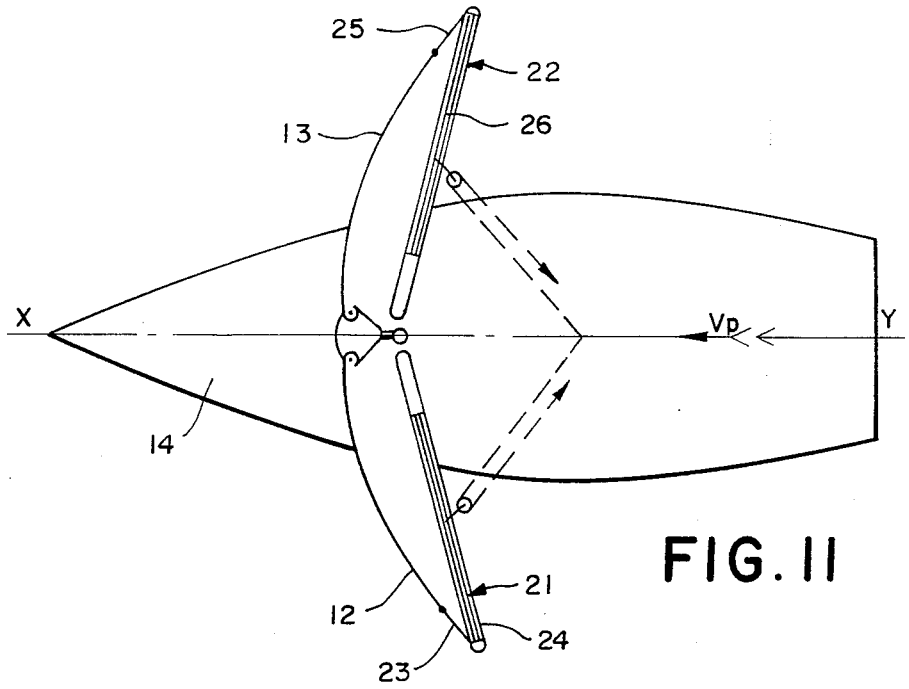
Figure 12:
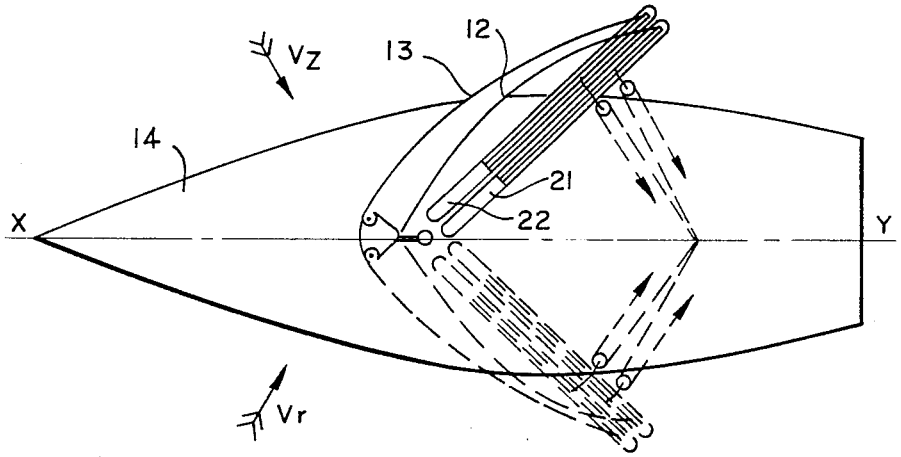

It is also possible to anchor the two sailcloths 12 and 13 to two distinct booms 21 and 22, as shown in FIGS. 11 and 12. In this case, the sailcloth 12 is anchored to the boom 21 by means of the check rope 23 and the rail 24, while the sailcloth 13 is anchored to the boom 22 by means of the check rope 25 and the rail 26. This allows the two booms 21, 22, when they are strictly joined and positioned only on one side of the boat (FIG. 12) to act as in the already described cases. FIG. 12 shows the position of the joined booms with a close-hauled wind blowing from Vz or from Vr. It is however possible, when sailing before the wind blowing from Vp, to draw apart the two booms 21 and 22 towards the two opposite sides of the boat 14—as shown in FIG. 11—and to use the two sailcloths 12 and 13 as two mainsails, thereby practically doubling the sailage.

Figure 15:
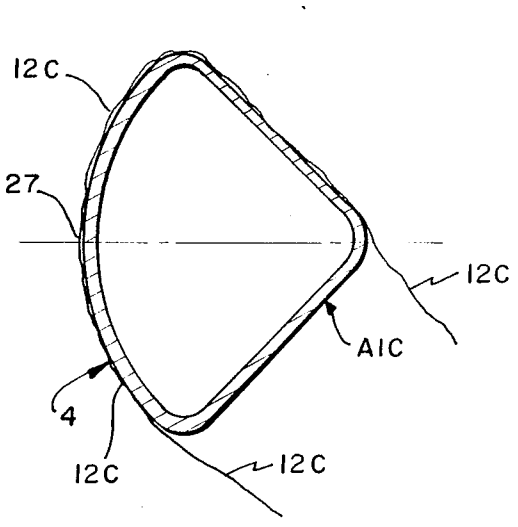
FIG. 15 is a section view of a still further simplified embodiment of said mast.
Figure 14:
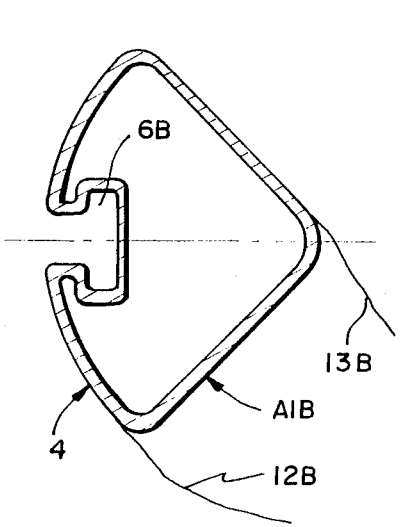
FIGS. 13 and 14 are section views of two further embodiments of the mast according to the invention.
Figure 13:
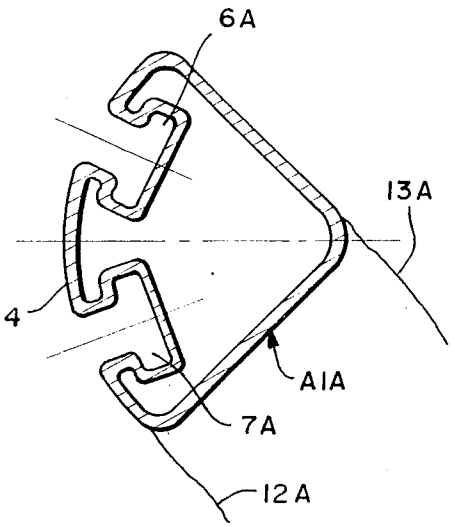

FIGS. 13 to 15 show further embodiments—the last one being particularly simplified—of the mast according to the invention.

In the embodiment of FIG. 13, the cross section of the mast AIA—still having the general shape of the previously described embodiment—comprises two cavities 6A and 7A opening outwards, formed in correspondence of two generatrices intersecting intermediate points of the curved section base 4. The two sailcloths 12A and 13A are anchored along said cavities substantially as in the previous case. The anchorage of the sailcloths can be obtained using known means—not shown—as a boltrope or an inner rail with bitts, provided in each cavity for each sailcloth.

In the embodiment of FIG. 14, the cross section of the mast AIB comprises a single cavity 6B, formed in correspondence of the generatrix crossing the centre of the curved section base 4 and opening outwards. The two sailcloths 12B and 13B are anchored along said cavity, using means as those specified heretofore. In this embodiment, the sailcloths 12B and 13B may form—on some types of boats, as those of the FINN class—two identical parts of a single sailcloth, anchored along its central part into the cavity 6B of the mast using the already mentioned means.

FIG. 15 shows a further embodiment of the cross section of the mast according to the invention—simplified in respect of the embodiment of FIG. 14—adopted when using a single sailcloth 12C, divided into two identical parts to form the sail according to the principles of the invention. In this case, the mast AIC comprises no cavities and the sailcloth 12C is anchored to the mast in 27—in correspondence of the generatrix crossing the centre of the curved section base 4—simply by glueing or like.

Figure 16:
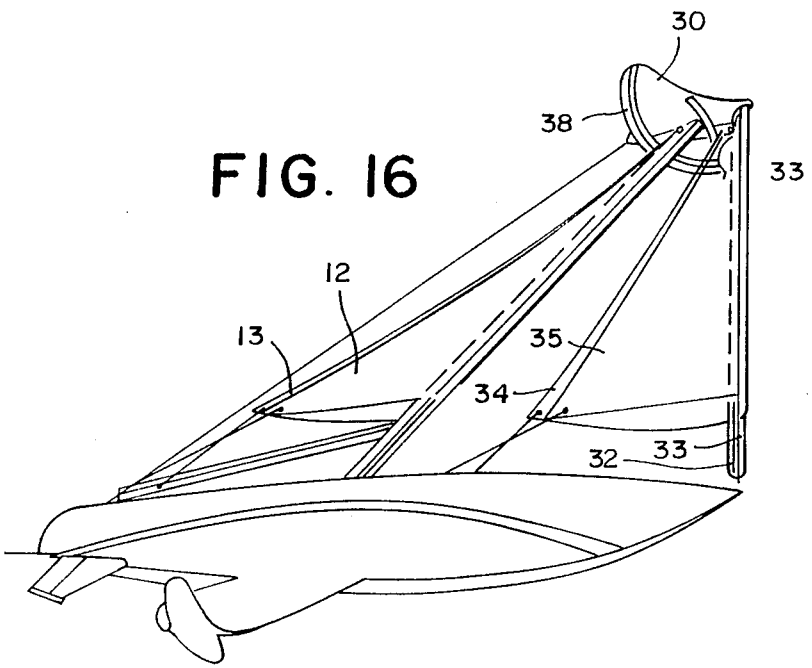
FIG. 16 is a diagrammatic comprehensive view of a sailboat equipped with an improved embodiment of the mast according to the invention, comprising a winglet fixed on the masthead.
Figure 18:
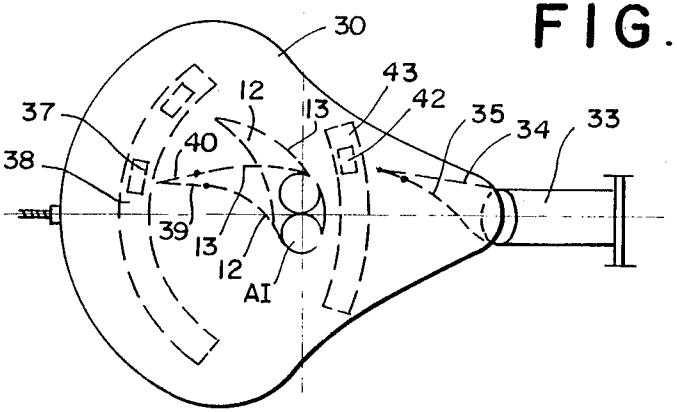
FIG. 18 is a plan view of the winglet, with respective guide means.

FIGS. 16 to 18 show a sailboat equipped with an improved embodiment of the mast according to the invention. As can be seen, a winglet 30 is fixed to the masthead. Said winglet 30—having a configuration similar to the known winglets applied on the wing tips of some modern airplanes—has a chord plane C-C forming, in respect of the plane O-O perpendicular to the axis Z-Z of the mast, an angle of between 0° and 30°, and preferably of 15°.

Said winglet 30 has first of all an aerodynamic function. It in fact, on one hand, checks and contains the air flow which tends to move upward, especially with a leaning boat and sail; it will thus be possible to take advantage of the regular air flow in the area underlying the winglet, so as to increase the size of the sailcloths in correspondence of their top end (as better described hereinafter). On the other hand, the winglet 30 also creates a lifting action which, thanks to its forward inclination, favours the movement of the boat.

It is evidently advantageous to obtain a correct wing contour also in correspondence of the masthead, where the wind speed is normally higher, whereby it becomes most important to convert whirlwinds (generating resistances) into regular flows, generating favourable wind thrusts.

As the top surface of the sailcloths is increased in size, it needs to be guided correctly; for this purpose—according to the invention—an arc-shaped rail 38 is applied on the lower surface of the winglet 30, along which moves a slider 37. Said slider forms an adjustable sheet point for two sheets 39, 40, engaging the top ends 12*a*, 13*a*, of the two sailcloths 12 and 13 of the wing sail; the sheets 39, 40, are then guided, by suitable transmission means, into the mast AI. The slider 37 is moved along the rail 38 by way of another sheet 36, guided above the winglet 30 and then also into the mast AI.

The rail 38 can be simply fixed, by any known means, to the lower surface of the winglet 30, or else—as shown in the drawings—it can be formed as a guide into the thickness of the winglet, so as to provide less aerodynamic resistance.

As shown in the lower part of FIG. 17, the mast AI has—in this embodiment—a slightly different cross section from that of the embodiment of FIG. 8; in fact, the two flat sides 8, 9 (embodiment of FIG. 8) are, in this case, radiused so as to form a single arc 8'; this arc has a bending radius which is smaller than the bending radius of the curved convex base 4' facing the bow of the boat. The result is thus a substantially elliptic cross section, which is asymmetrical in respect of its major axis, this latter being perpendicular to the median plane x-y of the mast.

According to another interesting aspect of the embodiment shown in FIGS. 16 to 18, the wing sail structure with two sailcloths—according to the invention—is not limited to the mainsail, but is repeated on the jib. As shown in FIGS. 16 to 18, to the topmast stay 32 there is associated a tubular body 33 substantially identical to the tubular body of the mast AI, that is, provided with two cavities 6', 7', for housing support mandrels for two sailcloths 34, 35, forming the jib.

As shown in the drawings, the topmast stay 32—which performs its normal function of anchorage—is housed into a central cavity of the tubular body 33 which, in this case, is only meant to house and guide the sailcloths forming the wing jib. As an alternative, it may be possible to anchor said tubular body 33 directly onto the bow and onto the masthead, thus causing it to perform also the function of stay. In both cases, the tubular body 33 can be mounted—as in the case of the mast AI—either fixed, or rotatable about its longitudinal axis.

Also for the jib, the top ends of the two sailcloths 34, 35, can be increased in size, and be guided—like the top ends of the sailcloths 12, 13—by sheets 44, 45. These latter have a sheet point onto a slider 42, sliding along an arc-shaped rail 43, which is fixed—similarly to the rail 38—onto the lower surface of the winglet 30.

FIGS. 19 to 21 finally illustrate an even further embodiment of the invention, wherein the mast comprises—along the generatrix crossing the centre of its rounded tip part facing the stern—a guide groove 50 for anchor means sliding along the mast. Said anchor means may consist, for example, of a conventional parrel 51 for the boom 52.

According to the present invention, carrier slides 53 are moreover slidably mounted along the guide groove 50, to each of said slides 53 there being anchored the foot 54 of a batten 55 for stiffening the wing sail. Unlike known technique—wherein the battens are firmly housed into appropriate pockets formed on each sailcloth—the invention provides (as clearly illustrated in FIG. 21) for each batten to freely move in the interspace between the two sailcloths, guided only by crosspieces 56. Said crosspieces may consist of straps, ropes or nets, allowing the battens to shift against either one of the two sailcloths, according to whether the sail positions itself on one side or on the other side of the boat (as clearly shown in FIG. 20).

FIG. 19 shows that the anchorage of the two sailcloths can be obtained, in a more conventional manner, by means of bitts engaging into guide grooves 57, 58. This embodiment, which should be fully considered as an alternative to that of FIGS. 8 to 12, has the known drawback of making it more difficult to unfurl the sails, but it obviously has the advantage of making the mast structure considerably lighter FIG. 22—which is a view similar to that of FIG. 16—shows a boat equipped with a mast as illustrated in FIGS. 19 to 21 and, furthermore, with a topmast stay comprising—like that of FIG. 16—a tubular body similar to the mast shown in FIG. 19, apt to support a jib with two sailcloths which can be reduced on the booms.

The mast according to the invention allows to obtain at least the following main results:

(1) The efficiency of the sail, and particularly of the mainsail, is increased, making its contour of correct shape (wing contour). In particular, the sail automatically takes up a correct wing contour when shifting from one side to the other of the boat, with no need to rotate the mast; the leading edge of the wing contour is asymmetrical—thereby improving the lifting action and the efficiency—in spite of the mast profile being symmetrical; there are no areas creating whirlwinds, in that the slots for anchorage of the sailcloths are always positioned on the front side of the mast, that is, windward;

(2) It allows to roll up the two sailcloths forming the sail at least partly inside the mast, so as to facilitate shortening the sail and allow spreading and stretching the two sailcloths to the required extent, in order to obtain the most suitable wing contour.

(3) Use can be made of two mainsails when sailing before the wind.

(4) The same advantages can be applied both to the mainsail and to the jib.

According to the invention, these results are obtained in a very simple, practical and reliable manner.

The invention can also be carried out in a different way from that heretofore described and illustrated, without thereby departing from its protection scope.

I claim:

1. Mast for sailboats comprising an elongated body connected at one end to a sailboat and having anchor means for supporting two distinct sailcloths forming a wing sail, wherein said body has a uniform cross section throughout its length divided into first and second parts by an axis transverse to the longitudinal axis of the boat, said first part facing the bow and a second part facing the stern, the first part facing the bow having a convexly curved profile, while the second part facing the stern has a rounded tip profile, wherein said anchor means for the two sailcloths forming the wing sail are positioned along two generatrices crossing two points which are symmetrical in respect of the centre of said first part facing the bow, and wherein the bow facing part of the elongated body together with a side portion of the stern facing portion forms the leading edge of a sail wing that has an aerodynamic shape in both of two close-hauling positions said sail wing assumes with respect to said sailboat, the cross-sectional shape of the aerodynamically shaped sail wing being asymmetric with respect to the direction of the wind.

2. Mast for sailboats as in claim 1, wherein the cross section of the elongated body is substantially like an isosceles triangle with a convexly rounded base that forms said first part of said cross section facing the bow and whose sides converge into a rounded apex forming said second part facing the stern.

3. Mast for sailboats as in claim 2, wherein the equal sides of the isosceles triangle form an angle of less than 45° in respect of said transverse axis of the mast.

4. Mast for sailboats as in claim 1, wherein said mast body has a substantially asymmetric elliptic cross section, having its major axis coinciding with said transverse axis, the part of said ellipse facing the stern having a bending radius which is smaller than the bending radius of the part facing the bow.

5. Mast for sailboats as in claim 1, wherein said anchor means for the two sailcloths forming the wing sail are positioned along two generatrices crossing two points which are symmetrical in respect of the centre and close to the ends of said transverse axis.

6. Mast for sailboats as in claim 5, wherein the cross section of said body includes at least one cavity that opens outwards into a slot extending along one of said generatrices, said slot being crossed by one of the sailcloths and said cavity housing said anchor means for said sailcloth.

7. Mast for sailboats as in claim 6, wherein each of said cavities has a circular shape, with a contour substantially tangent and radiused to the contour of the mast section, and said slot has smoothly radiused edges.

8. Mast for sailboats as in claim 6, wherein said anchor means consist of a support mandrel, positioned at the centre of each cavity, onto which is rolled up one of said sailcloths.

9. Sailboat characterized by being equipped with a mast as in claim 8.

10. Sailboat as in claim 9, characterized in that said mast is mounted fixed.

11. Sailboat as in claim 9, characterized in that said mast is mounted so as to rotate.

12. Sailboat as in claim 9, wherein, to the support mandrels for rolling up the sailcloths, housed in said cavities of the mast, there are associated means to cause the rotation of said mandrels by manual control of a mechanical transmission.

13. Sailboat as in claim 9, wherein, to the support mandrels for rolling up the sailcloths, housed in said cavities of the mast, there are associated means to cause the rotation of said mandrels, controlled by a motor means.

14. Sailboat as in claim 9, comprising a single boom, onto which are jointly anchored the two sailcloths of the wingsail.

15. Sailboat as in claim 9, comprising two distinct booms, onto each of which is anchored one of the two sailcloths of the wingsail, means being moreover provided to control said booms jointly, and separately.

16. Mast for sailboats as in claim 6 wherein, said anchor means consist of a boltrope housed inside each cavity.

17. Mast for sailboats as in claim 1, wherein said two sailcloths are connected together into a single sailcloth, folded around and fixed along its central part to the mast body, along a generatrix crossing the centre of said first part facing the bow.

18. Mast for sailboats as in claim 17, wherein the central part of said single sailcloth is fixed to the mast by glueing.

19. Mast for sailboats as in claim 1, further comprising supplementary anchor means for the boom, said anchor means being positioned along a generatrix crossing the centre of said second part facing the stern.

20. Mast for sailboats as in claim 19, wherein said supplementary anchor means includes a guide groove formed on the mast along said generatrix, and at least one carrier slide slidable in said groove.

21. Mast for sailboats as in claim 20, wherein said carrier slide is a boom parrel.

22. Mast for sailboats as in claim 20, wherein said supplementary anchor means includes a plurality of carrier slides, each forming a single anchor means for a batten stiffening the sail.

23. Mast for sailboats as in claim 1, wherein said mast body is formed as an extruded tubular body of light alloy.

24. Mast for sailboats as in claim 1, wherein said mast body is formed with synthetic fibres and hardening compounds.

25. Mast for sailboats as in claim 1, wherein said cross section gets smaller towards the top.

26. Mast for sailboats as in claim 1, further comprising a winglet fixed to the top end of the mast body, the chord plane of said winglet forming, with a plane perpendicular to the axis of the mast body, an angle of between 0° and 30°.

27. Mast for sailboats as in claim 26, wherein said winglet has, as seen in plan, a tapered tip profile towards the bow and a rounded widened profile towards the stern.

28. Mast for sailboats as in claim 26, wherein said winglet, includes on its lower surface, at least one arc-shaped rail for a movable slider, said slider forming a sheet point for the rope ends of the sails.

29. Mast for sailboats for forming an aerodynamically shaped sail wing from first and second opposing sailcloths that maintains an aerodynamic shape regardless of which of two close-hauling positions said sail wing assumes relative to said sailboat, comprising an elongated body fixedly mounted at one end to said sailboat, said body having a cross sectional shape that is constant throughout the length of the mast body and that includes a convex bow-facing portion whose opposing sides terminate in parallel edges, each of which supports an edge portion of a different one of said sailcloths, and a tapered stern facing portion whose opposing sides terminate in parallel edges that adjoin the parallel edges of the convex bow-facing portion wherein the bow-facing portion of said mast body together with a side portion of said stern-facing portion forms the leading edge of a sail wing that has an aerodynamic shape in both of said two close-hauling positions said sail wing assumes with respect to said sailboat, the cross-sectional shape of both the tapered stern-facing portion and the convex bow-facing portion being symmetrical with respect to the longitudinal axis of the boat, but the cross-sectional shape of the aerodynamically shaped sail wing being asymmetric with respect to the direction of the wind.

* * * * *